US005329827A

United States Patent [19]

Sell

[11] Patent Number: 5,329,827

[45] Date of Patent: Jul. 19, 1994

[54] FUNCTION SELECTOR KNOB LOCK

[75] Inventor: Leslie J. Sell, Bothell, Wash.

[73] Assignee: Ingersoll-Rand Company, Woodcliff Lake, N.J.

[21] Appl. No.: 6,541

[22] Filed: Jan. 21, 1993

[51] Int. Cl.[5] ..... G05G 1/10

[52] U.S. Cl. ..... 74/553; 74/526; 403/103

[58] Field of Search ..... 74/553, 526, 527, 504, 74/545; 403/335, 103

[56] References Cited

U.S. PATENT DOCUMENTS

| | | | |
|---|---|---|---|
| 3,570,325 | 3/1971 | Kroll et al. | 403/103 |
| 3,999,442 | 12/1976 | Decker et al. | 74/553 |
| 4,113,399 | 9/1978 | Hansen | 74/553 |
| 4,237,746 | 12/1980 | Rossi et al. | 74/504 |
| 4,390,859 | 6/1983 | Kasprzyk et al. | 74/553 X |
| 4,565,350 | 1/1986 | Rozek | 74/553 X |
| 4,920,824 | 5/1990 | Ward | 74/553 |
| 5,020,389 | 6/1991 | Sigler | 74/527 X |
| 5,039,830 | 8/1991 | Orillard | 74/553 X |
| 5,129,283 | 7/1992 | Koehler | 74/526 X |
| 5,232,140 | 8/1993 | Gregory et al. | 74/553 X |

FOREIGN PATENT DOCUMENTS

| | | | |
|---|---|---|---|
| 0483557 | 5/1992 | European Pat. Off. | 74/553 |
| 2219377 | 12/1989 | United Kingdom | 74/545 |

*Primary Examiner*—Vinh T. Luong
*Attorney, Agent, or Firm*—Walter C. Vliet

[57] ABSTRACT

A deformable flat spring is disposed between a rotating selector knob and a stop to prevent unwanted rotation of the selector knob and wherein release of the stop requires displacement of the knob in an axial direction relative to the stop to deform the flat spring thereby permitting escape of the stop and selective rotation of the knob.

4 Claims, 2 Drawing Sheets

FUNCTION SELECTOR KNOB LOCK

BACKGROUND OF THE INVENTION

This invention relates generally to devices for retaining a selected knob selected function as may be used in lever operated hoisting devices or the like and more particularly to a device for preventing the unwanted selection of a free-chain release of the hoisting chain.

Lever operated hoists are known in the prior art. Such prior art devices are known to include a selection feature wherein the hoist brake system may be temporarily released to permit the free-chain release of the hoisting chain to allow rapid deployment of the chain without the need for hand cranking out the chain. Selection of this function may be accomplished by rotating a hand operated selector knob to select the desired function. It should be appreciated, however, that the unwanted selection of the brake release function is to be avoided.

The foregoing illustrates limitations known to exist in present devices and methods. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention this is accomplished by providing a selector lock for a lever hoist function selector knob comprising a selector knob comprised of a first shaft mounted stop and a second hand operated knob co-axially mounted about the stop for rotation and axial displacement thereabout; the stop and the hand operated knob having co-planer surfaces in one position retaining mode and corresponding non co-planer surfaces in a second position selecting mode; deformable spring means secured to one of the surfaces and in selected contact with the other of the surfaces in response to axial displacement of the hand operated knob relative to the stop; and the spring means permitting relative rotation between the stop and the hand operated knob in one axial relative position between the stop and the hand operated knob and preventing relative rotation between the stop and the hand operated knob in a second axial relative position between the stop and the hand operated knob.

The foregoing and other aspects will become apparent from the following detailed description of the invention when considered in conjunction with the accompanying drawing figures.

BRIEF DESCRIPTION OF THE DRAWING FIGURES

DETAILED DESCRIPTION

Hand lever operated chain hoists and the like often include a manually operable knob to provide both a rapid means of taking up excess chain and as a selector for the free-chain function. The free-chain function allows rapid deployment of the lifting chain without the need to hand crank the chain out. Particularly in the case where the knob is manually operated, it is important that the selected function be retained during manual or accidental manipulation of the knob.

Figure 1:
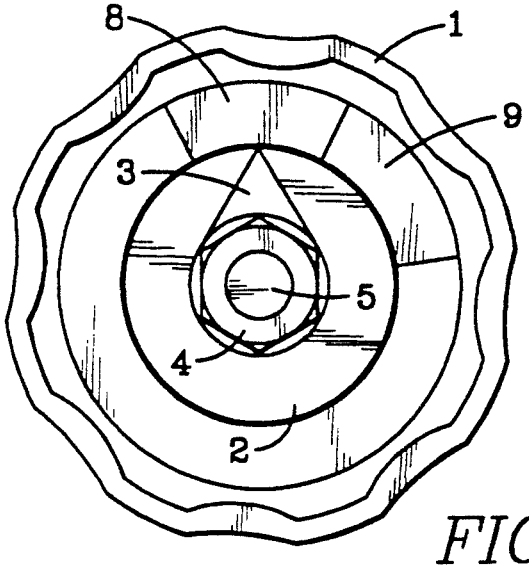
FIG. 1 is an elevation view of a function selector knob according to the present invention.

According to the present invention, as shown in FIG. 1, a manually operable selector knob 1 is provided having a lockable function selected feature. The exterior features of the knob are generally shown in FIG. 1 and include the selector knob 1 which is mounted for rotation about a shaft 5. The selector knob 1 is secured to the shaft by means of a retainer 2 and a retainer nut 4, as will be described later.

A pointer arrow 3, which may be painted, embossed, or otherwise disposed on the surface of the retainer 2, is provided as a relative indicator of the position of the selector knob relative to the shaft 5. As the selector knob is rotated relative to the shaft 5, the pointer will point to indicated selected functions as, for example, the lift sector 8, also designated with an L, or the free spool sector 9, also designated with the letters FS.

Figure 2:
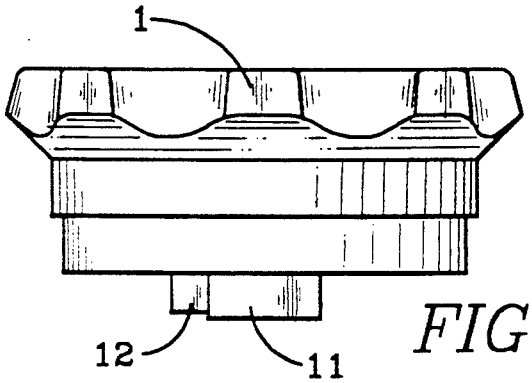
FIG. 2 is a top view of a function selector knob according to the present invention.

FIG. 2 shows a top view of the selector knob 1 showing the projection rearward of two function producing dogs identified as a biasing dog 11 and a stop dog 12.

It is sufficient for purposes of understanding the present invention that the relative positioning of the dogs 11, 12, in rotation about the shaft 5, effect the desired function.

Figure 3:
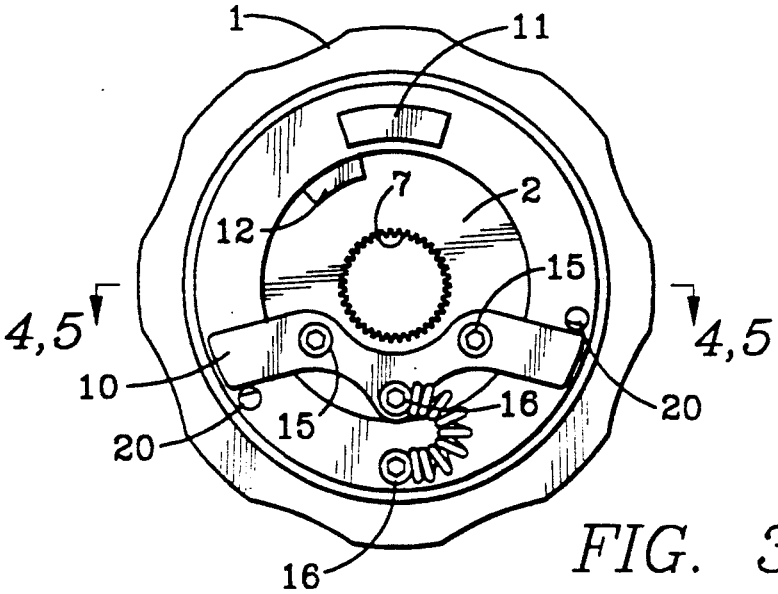
FIG. 3 is a rear elevation view of a function selector knob according to the present invention.

FIG. 3, which is a rear elevation view of the selector knob, shows one relative position of the function dogs.

Figure 4:
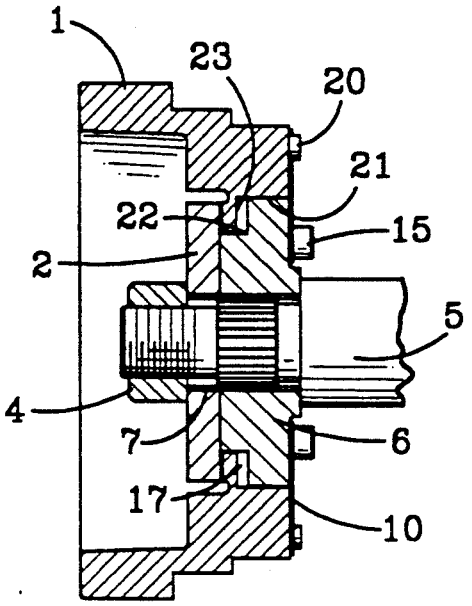
FIG. 4 is a cross sectional view of a function selector knob according to the present invention taken at section 4,5—4,5 of FIG. 3 showing the selector knob in the locked position.

As shown in FIG. 4, a stop 6, which is essentially in the form of a stepped thick washer, is secured against rotation relative to the shaft by means of a spline 7, and held securely on the shaft by means of the retaining nut 5 and the retainer 2.

The selector knob 1 is free to rotate about the bearing surface 21 provided between the stop 6 and the selector knob 1. A ring ledge 23 provided on the selector knob is captured between the retainer 2 and a step 22 formed in the stop 6. The ring ledge 23 is narrower than the gap 17 provided between the step 22 and the retainer, thereby permitting limited axial displacement of the selector knob relative to the stop 6.

As best seen in FIGS. 3 and 4, a flat leaf selector lock spring 10 is secured to the stop 6 by means of a pair of socket headed cap screws 15. A biasing spring 14 is shown disposed between the knob 1 and the stop 6 and is held in place by two capscrews 16. The biasing spring resiliently urges relative rotation of the knob to the stop.

For purposes of the present application it is sufficient to understand that the selector lock spring 10 prevents relative rotation of the selector knob relative to the stop by contacting stop pins 20 disposed about the outer periphery of the selector knob (as best seen in FIG. 3). In this case the relative rotation of the knob is in the clockwise direction, as viewed from the back. As shown, this would prevent the selector knob from being rotated in the counterclockwise direction as shown in FIG. 1 from the lift sector 8 selection to a free spool sector selection 9.

Since the selector knob also accomplishes the function selection through the function selection dog 11, the free spool function cannot be obtained without releasing the selector lock.

Figure 5:
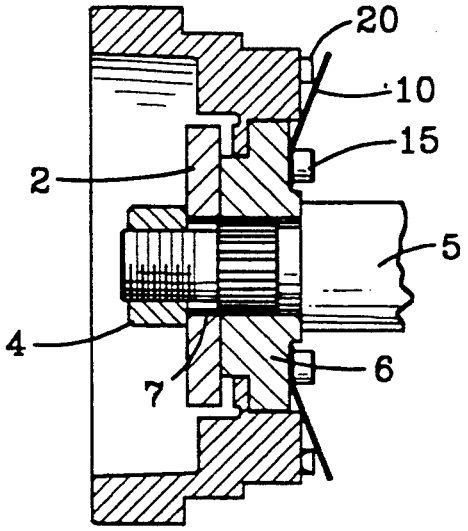
FIG. 5 is a cross sectional view of a function selector knob according to the present invention taken at section A—A of FIG. 3 showing the selector knob in the depressed release position.

Release of the selector lock is accomplished, as shown in FIG. 5, by axially depressing the knob to the right. In the depressed position, as shown in FIG. 5, the inner edge of the knob contacting the deflectable selector lock spring 10 will cause it to deflect outwards to thereby pass over the stop 20. In the depressed position, the selector knob may be rotated to the free spool sector 9 and to thereby select that function for the lever hoist.

Figure 6:
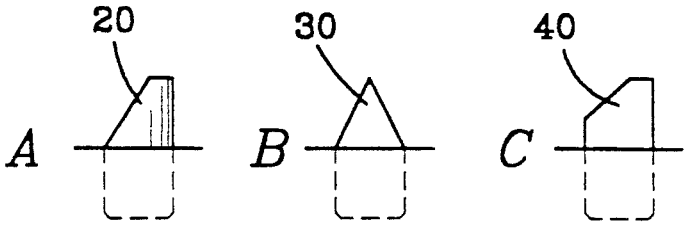
FIG. 6 shows a selection of three different stop pins which may be utilized to provide different stop functions.

The shape of the stop pin 20 may be utilized to accomplish different locking functions in different directions. For example, if the stop pin is shaped as shown in FIG. 6A (20), rotation in one direction may be accomplished only by depressing the knob. However, in the opposite direction, the stop pin would act merely as a detent as the selector lock spring would ride up over the sloped edge of the stop. A stop pin configuration as shown by FIG. 6B (30) would result in detent action only in both directions. The stop pin of FIG. 6C (40) would accomplish a full depressed stop in one direction and a combination stop detent condition in the reverse direction.

It should be understood that any combination of stop pin shape could be utilized to obtain the desired degree of stop or detent desired. It should also be understood that the flexibility of the selector lock spring 10 may be chosen to effect the degree of force necessary to accomplish the depression required for stop release. Further, that the selector lock spring 10 will return the knob to the locked position upon selection and release of the knob.

I claim:

1. A selector lock in combination with a hoist function selector knob comprising:

a selector knob assembly comprised of a shaft mounted stop and a hand operated knob co-axially mounted about said stop for rotation and axial displacement thereabout;

said stop and said hand operated knob having co-planar surfaces in one position retaining mode and corresponding non co-planar surfaces in a second position selecting mode;

deformable spring means secured to one of said co-planar surfaces and in selected contact with the other of said co-planar surfaces in response to axial displacement of said hand operated knob relative to said stop; and said deformable spring means coacts with a stop pin on the other of said co-planar surfaces.

2. A selector lock in combination with a hoist function selector knob according to claim 1, wherein said deformable spring means is further comprised of a flat leaf spring.

3. A selector lock in combination with a hoist function selector know according to claim 2, wherein said flat leaf spring is in the form of a gull wing flat spring attached to said stop.

4. A selector lock in combination with a hoist function selector knob according to claim 1, wherein said deformable spring means is attached to said stop and coacts with a stop pin on said hand operating knob.

* * * * *